US006310578B1

(12) United States Patent
Ying

(10) Patent No.: US 6,310,578 B1
(45) **Date of Patent: *Oct. 30, 2001**

(54) MULTIPLE BAND TELESCOPE TYPE ANTENNA FOR MOBILE PHONE

(75) Inventor: Zhinong Ying, Lund (SE)

(73) Assignee: Telefonaktiebolaget LM Ericsson (publ), Stockholm (SE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/958,842

(22) Filed: Oct. 28, 1997

(51) Int. Cl.[7] ..... H01Q 1/24

(52) U.S. Cl. ..... 343/702; 343/895; 343/901

(58) Field of Search ..... 343/702, 900, 343/901, 895; H01Q 1/24

(56) References Cited

U.S. PATENT DOCUMENTS

| | | | | |
|---|---|---|---|---|
| 676,332 | | 6/1901 | Marconi . | |
| 4,868,576 | | 9/1989 | Johnson, Jr. | 343/702 |
| 5,317,325 | | 5/1994 | Bottomley | 343/702 |
| 5,446,469 | | 8/1995 | Makino . | |
| 5,467,096 | | 11/1995 | Takamoro et al. | 343/702 |
| 5,546,094 | | 8/1996 | Egashira | 343/702 |
| 5,548,827 | | 8/1996 | Hanawa et al. | 455/129 |
| 5,550,820 | | 8/1996 | Baran . | |
| 5,594,457 | | 1/1997 | Wingo . | |
| 5,612,704 | | 3/1997 | Cole | 343/702 |
| 5,635,943 | | 6/1997 | Grunwell . | |
| 5,661,496 | | 8/1997 | Baek et al. | 343/702 |
| 5,945,953 | * | 8/1999 | Tsuda et al. | 343/702 |
| 5,945,964 | * | 8/1999 | DeGroot et al. | 343/702 |
| 6,031,493 | * | 2/2000 | Tsuda et al. | 343/702 |

FOREIGN PATENT DOCUMENTS

| | | | |
|---|---|---|---|
| 3129045 A | 10/1982 | (DE) . | |
| 0511 577 A2 | 11/1992 | (EP) . | |
| 2664749 A | 1/1992 | (FR) . | |
| 6-37531 | 2/1994 | (JP) | H01Q/11/08 |
| H10173430 A | 6/1998 | (JP) . | |

OTHER PUBLICATIONS

Patent Abstracts of Japan, JP–0236602, Sep. 30, 1994.

"Antennas" by J.D. Kraus, (McGraw–Hill Book Co., Inc.) pp. 173–178 (1950).

"Microwave Scanning Antennas" edited by R.C. Hansen, Peninsula Publishing, pp. 116–122 (1950).

* cited by examiner

*Primary Examiner*—Michael C. Wimer
(74) *Attorney, Agent, or Firm*—Burns, Doane, Swecker & Mathis, L.L.P.

(57) ABSTRACT

A multiple band antenna assembly for a portable hand held communication device. The antenna assembly includes a fixed multiple band base antenna element and a whip antenna which can be adjusted between extended and retracted positions. The whip antenna includes a telescoping metal portion having a length selected to achieve resonance in multiple frequencies. In the extended position, the whip antenna is electromagnetically coupled to the base antenna element without metal to metal contact. The antenna is mechanically simple and requires only a single port for multiple band operation.

6 Claims, 4 Drawing Sheets

MULTIPLE BAND TELESCOPE TYPE ANTENNA FOR MOBILE PHONE

FIELD OF THE INVENTION

The present invention relates generally to antenna design for portable communication devices. More particularly, the present invention relates to a multiple band telescoping antenna.

BACKGROUND OF THE INVENTION

Many different digital systems, such as GSM, DCS, PCS, D-AMPS, are used for cellular networks, frequently within the same service area. These systems typically operate in different frequency ranges—for example, the GSM system operates at 890–960 MHZ, and the DCS system operates at 1710–1880 MHZ. In service areas where multiple frequency ranges are used, a dual mode mobile telephone or mobile data terminal which can operate in different systems is desirable. Dual mode phones have been developed which require dual band miniature antennas.

Some efforts on the dual band antennas design has been done. The Japanese patent (6-37531) discloses a helix which contains an inner parasitic metal rod. In this antenna, the antenna can be tuned to dual resonant frequencies by adjusting the position of the metal rod. Unfortunately, the band width for this design is too narrow for use in cellular communications. Dual band printed monopole antennas are known in which dual resonance is achieved by the addition of a parasitic strip in close proximity to a printed monopole antenna. While such an antenna has enough bandwidth for cellular communication, it requires the addition of a parasitic strip. Moteco AB in Sweden has designed a coil matching dual band whip antenna and coil antenna, in which dual resonance is achieve by adjusting the coil matching component ($\frac{1}{4}\lambda$ for 900 MHZ and $\frac{1}{2}\lambda$ for 1800 MHZ). While this antenna has relatively good band width and radiation performances, its length is only about 40 mm. A non uniform helical dual band antenna which is relatively small in size is disclosed in Applicant's copending, commonly assigned application entitled "Multiple Band Non-Uniform Helical Antennas", Ser. No. 08/725,507, now U.S. Pat. No. 6,112,102, the entirety of which is incorporated by reference.

It is known that an extended whip antenna has a higher efficiency when the phone is relatively close to a human head. Typical dual band extendable whip antennas, such as those mentioned above, require a complicated matching network to match the whip antenna impedance to the two bands within 50 ohms. A dual band retractable antenna is disclosed in Applicant's copending, commonly assigned application entitled "Retractable Multi-Band Antennas", Ser. No. 08/725,504,now U.S. Pat. No. 5,963,871 the entirety of which is incorporated by reference. Such an antenna requires two ports, one for a helical antenna and another for a whip antenna. A means for switching between the ports for the different modes is required.

SUMMARY OF THE INVENTION

It would be desirable for a multiple band antenna to avoid complexities such as switching between ports, additional parasitic strips, and complicated impedance matching networks while having a bandwidth suitable for cellular communications. It would also be desirable for such an antenna to achieve high-quality communication performance while being compact in size so as to require relatively little storage space within a hand-held portable communication device.

The present invention overcomes the above-mentioned problems, and achieves other advantages, by providing for an extendable dual band antenna which has a single port for both extended and retracted whip positions. The single port is made possible by using an electromagnetic coupling technique in which metal-to-metal contact between the extendable whip antenna and the base antenna is avoided. A branch antenna or a non uniform helical antenna can be used as a base antenna. The telescoping whip antenna operates as a passive antenna when the whip is in an extended position, while a fixed base antenna operates as an active antenna. The total length of the whip is selected to optimize the radiation efficiency for multiple bands (i.e., for the GSM and DCS bands). When the phone is used close to a user's head, the extended whip can decrease body loss, thereby increasing radiation efficiency.

BRIEF DESCRIPTION OF THE DRAWINGS

The present invention and its advantages can be more fully understood upon reading the following Detailed Description of Preferred Embodiments in conjunction with the accompanying drawings, in which like reference indicia designate like elements, and in which.

DETAILED DESCRIPTION OF PREFERRED EMBODIMENTS

A multiple mode antenna according to the present invention preferably uses a dual band base antenna as an active antenna for both the retracted and extended positions of the whip antenna. The antenna feed connector between the base antenna and the receiver circuitry of the portable communication device is fixed. To store the antenna in the relatively small space available in a hand held portable communication device, the whip antenna is preferably a telescoping antenna to achieve a length which will resonate at multiple frequencies.

Figure 1:
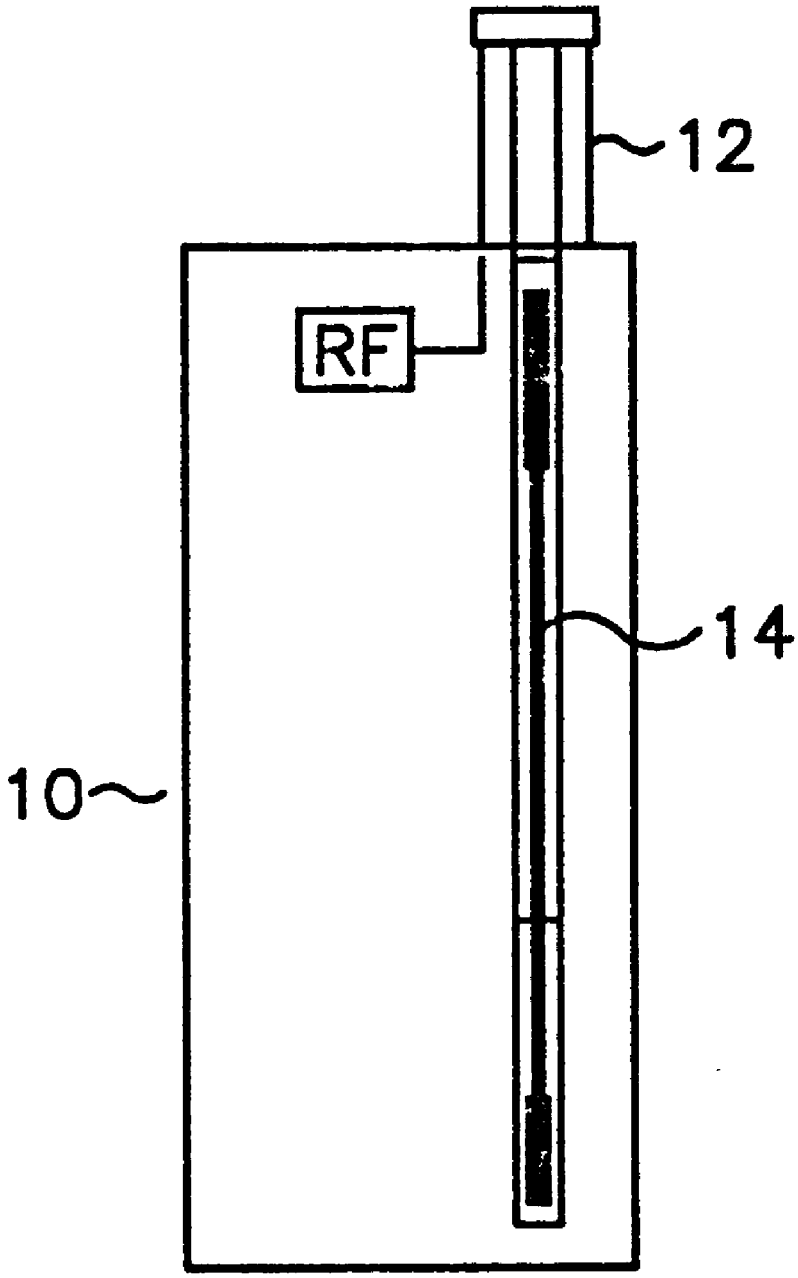
FIG. 1 shows a hand-held portable communication device provided with a multiple-mode antenna according to one embodiment of the present invention, the antenna being in a retracted position.

Referring now to FIG. 1, a hand held portable communication device 10 having an antenna assembly according to the present invention is shown. The antenna assembly includes a fixed base antenna element 12 and an extendable whip antenna 14. The fixed base antenna can exchange communication signals in multiple bands, and interfaces with transceiver processing circuitry (not shown) contained within the device 10 via an antenna feed connector RF. The base antenna 12 can be a dual band helix antenna, a multiple band branch printed antenna, or other suitable multiple band antenna. As will be discussed below, a multiple band branch printed antenna is preferred. The extendable whip antenna 14, shown in a retracted position for storage inside the device 10, contains several elements arranged to allow the antenna 14 to be extended. The whip antenna 14 and its component elements are better shown and described with respect to FIG. 2.

Figure 2:
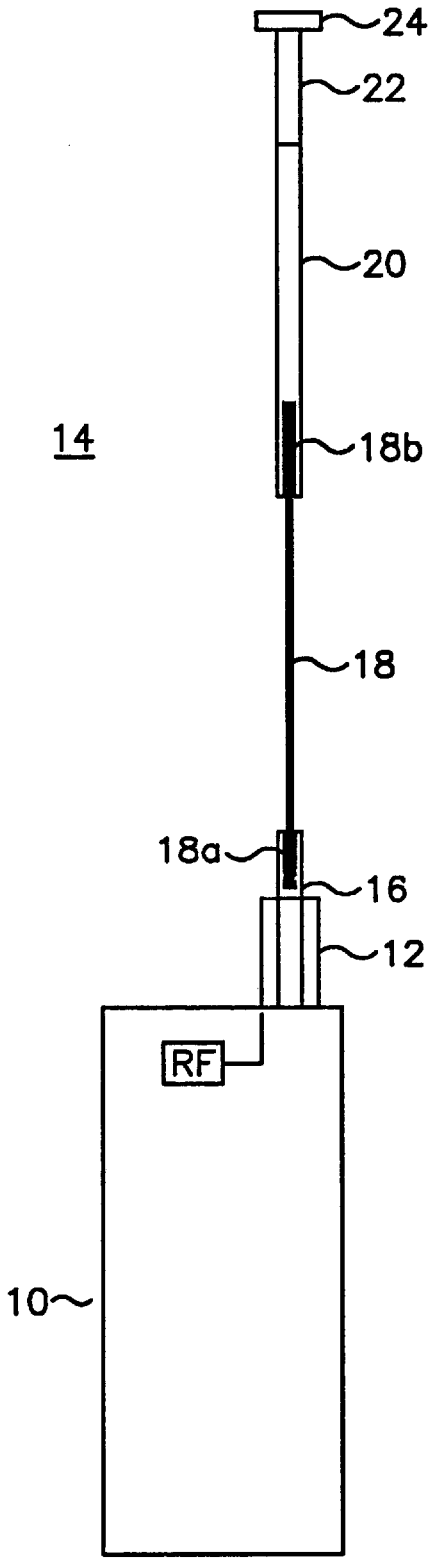
FIG. 2 shows the antenna of FIG. 1 in an extended position.

FIG. 2 shows the portable communication device 10 and antenna assembly of FIG. 1 in the case where the whip antenna 14 is in an extended position. As shown, the whip antenna 14 includes a tube 16 (of, e.g., plastic or some other suitable non-conductive material) slidably engaged with the device 10 such that the tube 16 can be extended to a position where at least a portion of the tube is located outside the device 10. Obviously, the tube 16 should be provided with a means such as a flange for preventing the entire whip antenna 14 from being removed from the device 10. The whip antenna 14 further includes a metal rod 18. The metal rod 18 has a first end 18*a* which is slidably contained within the tube 16, and a second end 18*b* which is slidably engaged with a metal tube 20. In the extended position shown in FIG. 2, a portion of the metal rod 18 between the first and second ends 18*a* and 18*b*, respectively, is exposed. Also as shown, the first and second ends 18 preferably have an increased diameter (as compared to the exposed portion) to maintain the integrity of the extendable whip antenna 14.

The whip antenna 14 further includes a metal tube 20, within which the second end 18*b* of the metal rod 18 is slidably retained. The metal tube 20 is connected to a rod 22 which is made of plastic or some other suitable non-conductive material. Referring back to FIG. 1, it can be seen that the rod 22 preferably has a length which corresponds to the length of the dual band base antenna 12. Rod 22 further includes a cap portion 24 which prevents the whip antenna elements from being pushed too far into the device 10, and which facilitates the retraction and extension of the whip antenna 14.

It should be appreciated that in the extended position shown in FIG. 2, the whip antenna 14 operates as a parasitic antenna. The metal rod 18 is exposed outside of the tubes 16 and 20 and is connected to the conductive metal tube 20. It should also be appreciated that there is no metal-to-metal contact between the whip antenna 14 and the base antenna 12. The whip antenna 14, in the extended position, is electromagnetically coupled with the base antenna 12, and enhances the performance of the antenna assembly in a manner to be described later. The single antenna feed connector provides a common port for both the extended and retracted positions of the whip antenna 14. There is no matching or switching network required to allow the antenna to resonate at frequencies in different bands.

Figure 3:
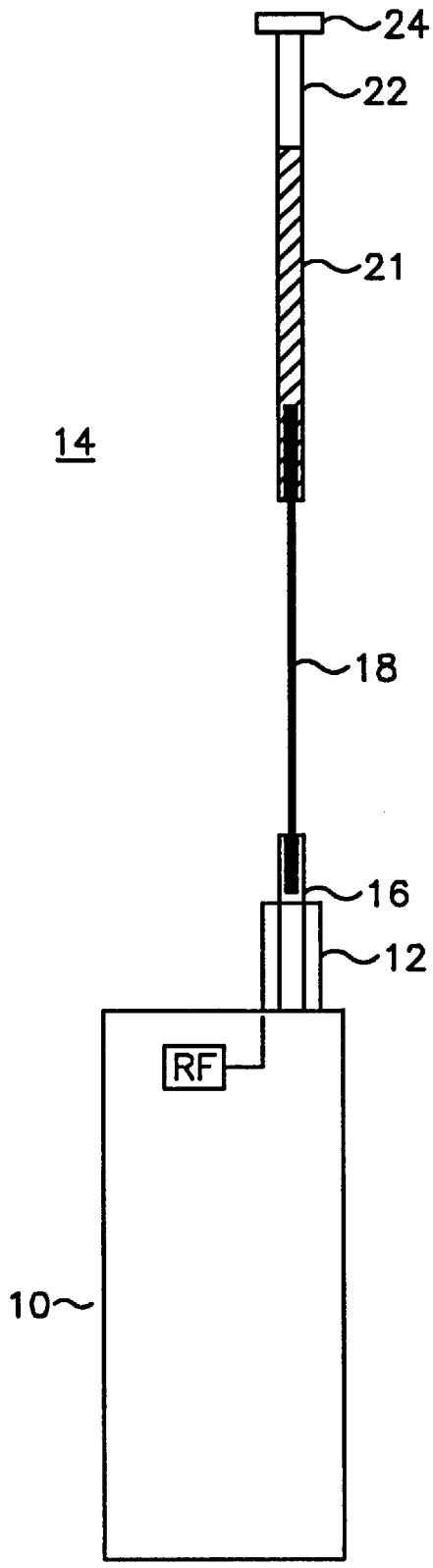
FIG. 3 shows an alternative antenna according to a second embodiment of the present invention in an extended position.

FIG. 3 shows an alternative embodiment of the whip antenna 14 according to the present invention. In this embodiment, the metal tube 20 is replaced by a non-conductive (e.g., plastic) tube 21 having one or more metal wires arranged in a coil or other suitable fashion. The antenna of FIG. 3 achieves substantially the same performance as that of FIG. 2.

Figure 4:
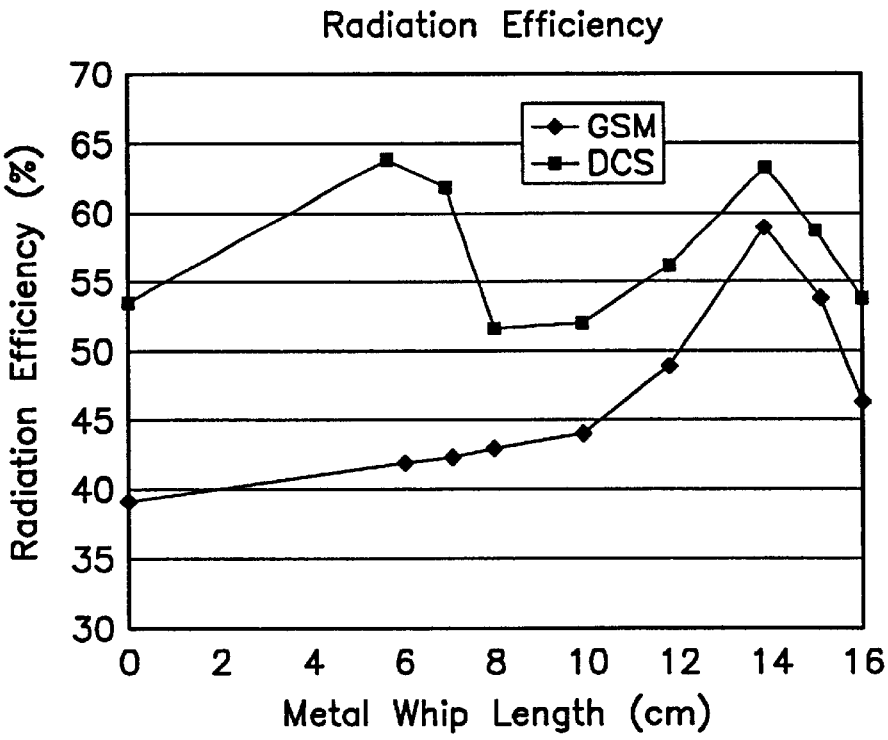
FIG. 4 is a graphical representation of talk position radiation efficiency in two bands of an antenna according to the present invention.

Referring now to FIG. 4, the talk position radiation efficiency of the antenna of FIGS. 1–2 for both the GSM and DCS bands are shown. The graph of FIG. 4 assumes that the portable communication device 10 is held close to a user's head. A typical stub (base) antenna achieves a radiation efficiency of approximately 40% for GSM and approximately 53% for DCS. As shown in FIG. 4, when the length of the metal portion of the whip antenna 14 is approximately 60 mm, a first efficiency peak is achieved for the DCS band only. When this length is increased to approximately 140 mm, a second efficiency peak is reached for both the GSM and DCS bands. At this length, the antenna is resonant for both bands, and the radiation efficiency is improved from the stub antenna case to approximately 59% for GSM and 64% for DCS. These improvements correspond to a gain increase of approximately 3–5 dB for the DCS band, and 5–8 dB for the GSM band. It should be appreciated that the telescoping design of the antenna of the present invention allows this length to be achieved while allowing the antenna to be stored inside the relatively small space available in the portable communication device 10.

Figure 5:
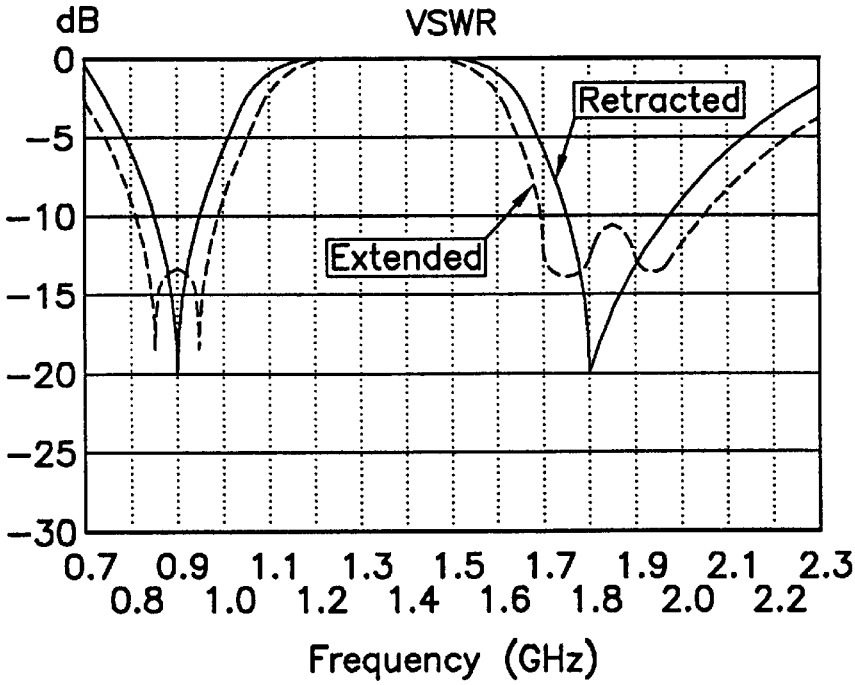
FIG. 5 is a graphical representation of return loss performance in two bands for an antenna according to the present invention.

To optimize the coupling, the distance between the metal portion of the whip antenna 14 and the base antenna 12 should be approximately 0.03 wavelength. Because the length between the whip and resonant parts of the base antenna should be measured in wavelength, the distance is ideally closer for DCS than for GSM. The extendable whip antenna according to the present invention is preferably used in conjunction with a base antenna such as that described in Applicant's copending, commonly assigned application entitled "Multi Band Multiple Branch Antenna for Mobile Phone", the entirety of which is hereby incorporated by reference. Such a branch antenna is particularly suitable for a base antenna in a dual band application because it has separate branches corresponding to different frequencies. In the present example, the distance between the metal portion of the whip antenna 14 and the relevant antenna branch should be approximately 9 mm for GSM, and approximately 4.5 mm for DCS, which can be achieved by selecting the length and arrangement of the crotch antenna branches. A graphical representation of return loss for retracted and extended cases is shown in FIG. 5. The graph assumes the coupling distances described above.

While the embodiments above have been described assuming that the antenna is used for both GSM (which operates at approximately 900 MHZ) and DCS which operates at approximately 1800 MHZ), the antenna can alternatively be designed to achieve resonance in the PCS band (which operates at approximately 1900 MHZ) or other frequency bands.

The foregoing description includes numerous details which are provided for instructional and explanatory purposes only. The specific examples discussed above are not to be construed as suggesting limitations of the invention; rather, these examples can be modified in many ways without departing from the scope of the invention, as defined by the following claims and their legal equivalents.

What is claimed is:

1. A multiple band antenna assembly containable within a hand-held portable communication device, comprising:

a single port base antenna operable in at least two frequency bands; and a whip antenna adjustable between extended and retracted positions and resonant at multiple frequencies, the whip antenna in the extended position being electromagnetically coupled to the base antenna without metal to metal contact with he base antenna wherein the whip antenna comprises a nonconductive tube slidably engaged with, and containable within, the hand-held portable communication device, a metal rod having a first end engaged with the nonconductive tube and a second end slidably engaged within a first end of the conductive tube, and a nonconductive rod connected to a second end of the conductive tube.

2. The antenna of claim 1, wherein the conductive tube is a plastic tube having at least one conductive wire.

3. The antenna of claim 1, wherein the conductive wire is arranged in a coiled fashion in the plastic tube.

4. A hand-held portable communication device, comprising:

a fixed base antenna operable in at least two frequency bands;

a whip antenna adjustable between extended and retracted position and resonant at multiple frequencies, the whip antenna in the extended position being electromagnetically coupled to the base antenna without metal to metal contact with the base antenna, and the whip antenna in the retracted position being contained within the communication device; and a single port between the base antenna and transceiver circuitry within the communication device, the single port providing signals to, and receiving signals from, the base antenna when the whip antenna is in a retracted position, and providing signals to, and receiving signals from the base antenna and the whip antenna when the whip antenna is in the extended position, wherein the whip antenna comprises a non-conductive tube slidably engaged with, and containable within, the hand-held portable communication device, a metal rod having a first end engaged with the non-conductive tube and a second end slidably engaged within a first end of a conductive tube, and a non-conductive rod connected to a second end of the conductive tube.

5. The antenna of claim 4, wherein the conductive tube is a plastic tube having at least one conductive wire.

6. The antenna of claim 5, wherein the conductive wire is arranged in a coiled fashion in the plastic tube.

* * * * *